US011222585B2

(12) United States Patent
Cai

(10) Patent No.: US 11,222,585 B2
(45) Date of Patent: Jan. 11, 2022

(54) PIXEL DRIVING CIRCUIT AND PIXEL DRIVING METHOD

(71) Applicant: SHENZHEN CHINA STAR OPTOELECTRONICS SEMICONDUCTOR DISPLAY TECHNOLOGY CO., LTD., Shenzhen (CN)

(72) Inventor: Zhenfei Cai, Shenzhen (CN)

( * ) Notice: Subject to any disclaimer, the term of this patent is extended or adjusted under 35 U.S.C. 154(b) by 153 days.

(21) Appl. No.: 16/626,344

(22) PCT Filed: Nov. 22, 2019

(86) PCT No.: PCT/CN2019/120269
§ 371 (c)(1),
(2) Date: Dec. 24, 2019

(87) PCT Pub. No.: WO2021/082122
PCT Pub. Date: May 6, 2021

(65) Prior Publication Data

US 2021/0335241 A1 Oct. 28, 2021

(30) Foreign Application Priority Data

Oct. 29, 2019 (CN) ..... 201911038710.2

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01); *G09G 2300/0809* (2013.01); *G09G 2310/0278* (2013.01); *G09G 2320/0257* (2013.01)

(58) Field of Classification Search
CPC ..... G09G 3/3233; G09G 2300/0809; G09G 3/3225–325
See application file for complete search history.

(56) References Cited

U.S. PATENT DOCUMENTS

| | | | | |
|---|---|---|---|---|
| 10,102,800 | B2 | 10/2018 | Jeong | |
| 2006/0097965 | A1 | 5/2006 | Deane et al. | |
| 2016/0217741 | A1 | 7/2016 | Tseng et al. | |
| 2018/0025690 | A1 | 1/2018 | Bao et al. | |
| 2019/0180686 | A1 | 6/2019 | Qu et al. | |
| 2020/0074929 | A1 | 3/2020 | Chen et al. | |
| 2021/0012709 | A1* | 1/2021 | Qian | G09G 3/3233 |

FOREIGN PATENT DOCUMENTS

| | | | |
|---|---|---|---|
| CN | 1742308 | A | 3/2006 |
| CN | 103927991 | A | 7/2014 |
| CN | 104751779 | A | 7/2015 |
| CN | 105609047 | A | 5/2016 |

(Continued)

*Primary Examiner* — Sanjiv D. Patel

(57) ABSTRACT

The present disclosure provides a pixel driving circuit and a pixel driving method. The pixel driving circuit includes a first transistor, a second transistor, a third transistor, a fourth transistor, and an organic light-emitting diode. When a first scan signal is at a high voltage potential, the second transistor transmits a data signal voltage to a gate of the first transistor. A driving current flows through the organic light-emitting diode to emit light.

6 Claims, 2 Drawing Sheets

(56) References Cited

FOREIGN PATENT DOCUMENTS

| | | | | |
|---|---|---|---|---|
| CN | 106097959 | A | | 11/2016 |
| CN | 206021875 | U | | 3/2017 |
| CN | 108039149 | A | | 5/2018 |
| CN | 108717841 | A | | 10/2018 |
| CN | 106097959 | A | * | 8/2019 |
| CN | 110136646 | A | | 8/2019 |
| CN | 110189691 | A | | 8/2019 |

* cited by examiner

PIXEL DRIVING CIRCUIT AND PIXEL DRIVING METHOD

CROSS REFERENCE TO RELATED APPLICATIONS

The present disclosure claims priority of China Patent application filed with the National Intellectual Property Administration on Oct. 29, 2019, application number is 201911038710.2 and the title is "pixel driving circuit, display panel, display device and pixel driving method". The content of the application is cited and incorporated in the present disclosure.

FIELD OF INVENTION

The present disclosure relates to the field of display technologies, particularly to a pixel driving circuit and a pixel driving method.

BACKGROUND OF INVENTION

Organic light-emitting diode (OLED) display panels have gradually become major technologies in the development of the display field due to advantages such as wider color gamut, higher contrast, higher luminosity, faster response times, lower power consumption, and flexibility. Due to the advantages above, in comparison with thin-film transistor (TFT) display, OLED display is more suitable for manufacturing large-size, thin, flexible, transparent, and dual-side displays.

As shown in FIG. 1, an OLED driving circuit 10 includes a switch transistor Tscan, a driving transistor Tdrive, and a storage capacitor Cst. A gate of the switch transistor Tscan is connected to a scan signal Scan, a source receives a data signal Vdata. When the scan signal Scan received by the gate being at a high voltage, the switch transistor conducts the data signal Vdata. A current provided to an organic light-emitting diode OLED is controlled by driving transistor Tdrive. A source of driving transistor Tdrive is connected to a voltage source ELVDD. A gate of driving transistor Tdrive is connected to a drain of switch transistor Tscan. Therefore, when switch transistor Tscan conducts the data signal Vdata, the driving transistor Tdrive will also be turned on and a current Ids flows through the organic light-emitting diode OLED.

Technical Problems

A threshold voltage of the driving transistor Tdriver is Vth. Voltages of the gate and the source voltages of the driving transistor Tdrive are Vg and Vs, respectively. The data signal Vdata writes different data signal voltage values according to grayscale values that screens required to display. A raise of the data signal Vdata will increase the current Ids flowing through the organic light-emitting diode OLED and increase screen brightness. However, if under an environment having strong external light, it is necessary to make the panel achieve high-brightness display (HDR). However, due to the limitations of TFT mobility and OLED luminous efficiency, if the high-brightness display HDR function is implemented by increasing the voltage of the data signal Vdata, a threshold voltage of the driving transistor Tdrive drifts because the gate received high voltage. As a result, serious afterimage problems happen.

Therefore, a pixel driving circuit and a pixel driving method are required to solve the problem of transistor threshold voltage drift when implementing high-brightness display.

SUMMARY OF INVENTION

The present disclosure provides a pixel driving circuit includes a first transistor, a second transistor, a third transistor, a fourth transistor, and an organic light-emitting diode. A source of the first transistor receives a high voltage source. A source of the second transistor receives a data signal voltage. A gate of the second transistor receives a first scan signal. A drain of the second transistor is connected to a gate of the first transistor. A source of the third transistor receives the high voltage source. A source of the fourth transistor receives the data signal voltage. A gate of the fourth transistor receives a second scan signal. A drain of the fourth transistor is connected to a gate of the third transistor. An anode of the OLED is connected to a drain of the first transistor and a drain of the third transistor, and a cathode of the OLED is connected to a low reference voltage potential. The source of the second transistor is connected to a first data signal line. The source of the fourth transistor is connected to a second data signal line. The source of the first transistor and the source of the third transistor are short-circuited. The drain of the first transistor and the drain of the third transistor are short-circuited.

Preferably, in a first frame, the first scan signal is at a high voltage potential, the second scan signal is at a low voltage potential, and the first transistor provides a first driving electric current to the OLED. In a second frame, the second scan signal is at a high voltage potential, the first scan signal is at a low voltage potential, and the third transistor provides a second driving electric current to the OLED.

Preferably, in a third frame, the first scan signal and the second scan signal are both at the high voltage potential, the first transistor provides the first driving electric current to the OLED, and the third transistor provides the second driving electric current to the OLED. A driving electric current flowing through the OLED is a sum of the first driving electric current and the second driving electric current.

The present disclosure further provides a pixel driving circuit includes a first transistor, a second transistor, a third transistor, a fourth transistor, and an organic light-emitting diode. A source of the first transistor receives a high voltage source. A source of the second transistor receives a data signal voltage. A gate of the second transistor receives a first scan signal. A drain of the second transistor is connected to a gate of the first transistor. A source of the third transistor receives the high voltage source. A source of the fourth transistor receives the data signal voltage. A gate of the fourth transistor receives a second scan signal. A drain of the fourth transistor is connected to a gate of the third transistor. An anode of the OLED is connected to a drain of the first transistor and a drain of the third transistor, and a cathode of the OLED is connected to a low reference voltage potential.

Preferably, in a first frame, the first scan signal is at a high voltage potential, the second scan signal is at a low voltage potential, and the first transistor provides a first driving electric current to the OLED.

Preferably, in a second frame, the second scan signal is at a high voltage potential, the first scan signal is at a low voltage potential, and the third transistor provides a second driving electric current to the OLED.

Preferably, in a third frame, the first scan signal and the second scan signal are both at the high voltage potential, the first transistor provides the first driving electric current to the OLED, the third transistor provides the second driving electric current to the OLED, and a driving electric current flowing through the OLED is a sum of the first driving electric current and the second driving electric current.

Preferably, the source of the second transistor is connected to a first data signal line, the source of the fourth transistor is connected to a second data signal line, the source of the first transistor and the source of the third transistor are short-circuited, and the drain of the first transistor and the drain of the third transistor are short-circuited.

Preferably, the second transistor transmits the data signal voltage to the gate of the first transistor when the first scan signal is at a high voltage potential. The fourth transistor transmits the data signal voltage to the gate of the third transistor when the second scan signal is at a high voltage potential.

The present disclosure further provides a pixel method including receiving a high voltage source by a source of a first transistor; receiving a data signal voltage by a source of a second transistor, wherein a gate of the second transistor receives a first scan signal, a drain of the second transistor is connected to a gate of the first transistor, and the second transistor transmits the data signal voltage to the gate of the first transistor when the first scan signal is at a high voltage potential; receiving the high voltage source by a source of a third transistor; receiving the data signal voltage by a source of a fourth transistor, wherein a gate of the fourth transistor receives a second scan signal, a drain of the fourth transistor is connected to a gate of the third transistor, and the fourth transistor transmits the data signal voltage to the gate of the third transistor when the second scan signal is at the high voltage potential; connecting an anode of an organic light-emitting diode (OLED) to a drain of the first transistor and a drain of the third transistor, and connecting a cathode of the OLED to a low reference voltage potential. When the first scan signal is at a high voltage potential and the second scan signal is at a low voltage potential, the first transistor provides a first driving electric current to the OLED. When the second scan signal is at a high voltage potential, the first scan signal is at a low voltage potential, and the third transistor provides a second driving electric current to the OLED.

Preferably, when the first scan signal is at the high voltage potential and the second scan signal is at the high voltage potential, the first transistor provides the first driving electric current to the OLED, the third transistor provides the second driving electric current to the OLED. A driving electric current flowing through the OLED is a sum of the first driving electric current and the second driving electric current.

Beneficial Effect

The advantage of the embodiment of the present disclosure is by utilizing the pixel driving circuit and the pixel driving method of the embodiment of the present disclosure, the problem of drifting threshold voltage of the driving transistors during high-brightness display can be improved and the chance of afterimages is reduced

DETAILED DESCRIPTION OF PREFERRED EMBODIMENTS

Figure 1:
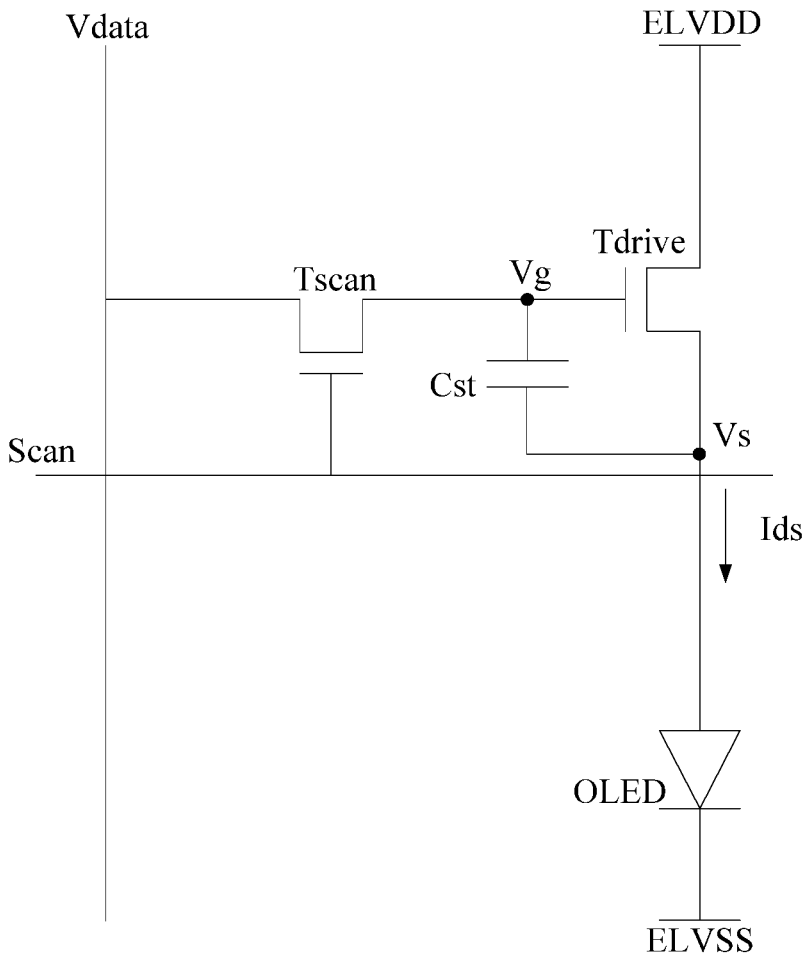
FIG. 1 illustrates a pixel driving circuit.

The following description of the various embodiments is provided with reference of drawings to illustrate specific embodiments. Directional terms mentioned in the present disclosure, such as upper, lower, front, back, left, right, inside, outside, lateral, etc., are only referring to the direction of the drawing. Therefore, the directional terms used to describe and clarify the present disclosure should not be viewed as limitations of the present disclosure. In the drawing, structurally similar elements are denoted by the same reference numbers.

Figure 2:
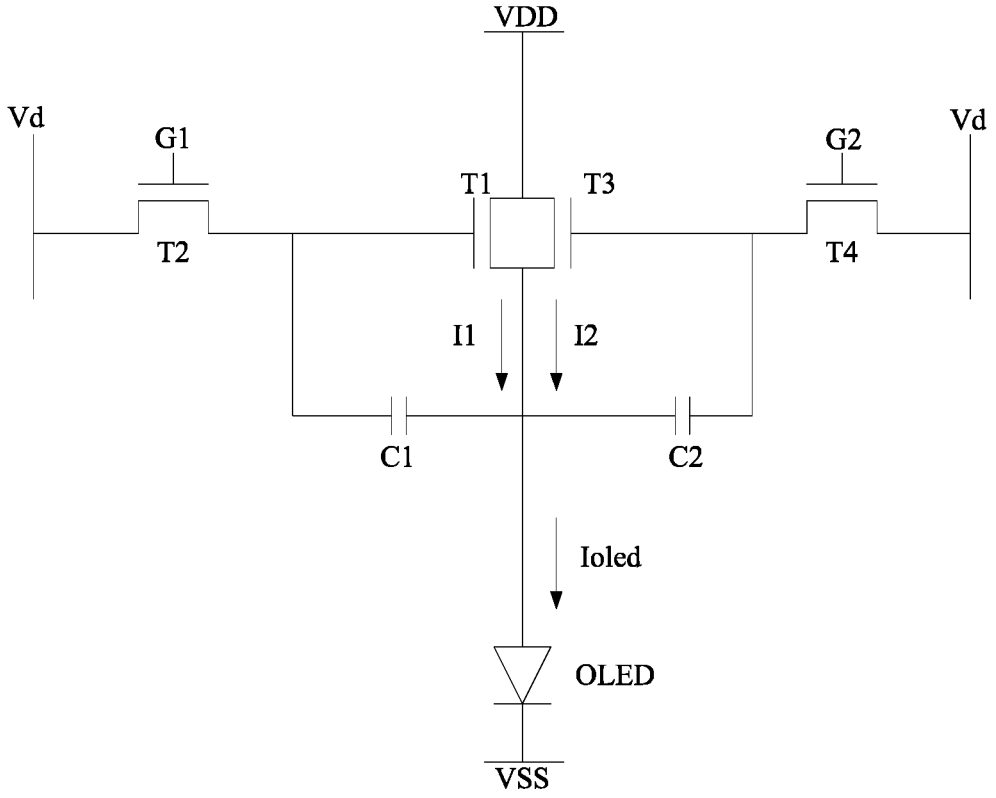
FIG. 2 illustrates a pixel driving circuit of an embodiment of the present disclosure.

Please refer to FIG. 2, which illustrates a pixel driving circuit of the embodiment of the present disclosure. The pixel driving circuit includes a first transistor T1, a second transistor T2, a third transistor T3, a fourth transistor T4, a first storage capacitor C1, a second storage capacitor C2, and an organic light-emitting diode (OLED). The first transistor T1 and third transistor T3 is the driving transistors. The second transistor T2 and the fourth transistor T4 are the switch transistors. A cathode of the OLED is connected to a low reference voltage potential VSS.

In the pixel driving circuit of the embodiment of the present disclosure, a source of the first transistor T1 is connected to a high voltage source VDD. A drain of the first transistor T1 is connected to an anode of the OLED. A source of the second transistor T2 receives data signal voltage Vd. A gate of second transistor T2 receives a first scan signal G1. A drain of second transistor T2 is connected to a gate of first transistor T1. A first storage capacitor C1 is connected between the gate of first transistor T1 and the drains of the first transistor T1. A source of the third transistor T3 is shorted to the source of the first transistor T1 and receives the high voltage source VDD. A drain of the third transistor T3 is shorted to the drain of the first transistor T1 and is connected to the anode of the OLED. A source of the fourth transistor T4 is connected to the data signal voltage Vd. A gate of fourth transistor T4 receives the second scan signal G2. A drain of fourth transistor T4 is connected to the gate of third transistor T3. A second storage capacitor C2 is connected between the gate of the third transistor T3 and the drain of the third transistor T3. When the first scan signal G1 is at a high voltage potential, the second transistor T2 conducts the data signal voltage Vd to the gate of the first transistor T1 and the first storage capacitor C1, and provides a first driving electric current I1 to the OLED. When the second scan signal G2 is at the high voltage potential, the fourth transistor T4 conducts the data signal voltage Vd to the gate of the third transistor T3 and the second storage capacitor C2, and provides a second driving electric current I2 to the OLED. A driving current flowing through the OLED is Ioled.

FIG. 2 only shows the pixel driving circuit of the preferred embodiment of the present disclosure, and is not intended to limit the present disclosure. For example, to optimize the display effect, the second transistor T2 and the fourth transistor T4 can be connected to different the data signal voltage. In other words, the source of the second transistor T2 and the source of the fourth transistor T4 are connected to different data signal lines, thereby different data signal voltages are provided to the second transistor T2 and the fourth transistor T4 in order to more precisely control to the driving current Ioled of the OLED.

The present disclosure further provides a display panel including the pixel driving circuit as shown in FIG. 2. The present disclosure further provides a display device having the display panel. The pixel driving circuit in the display panel and display device provided by the present disclosure receives two scan signals (the first scan signal G1 and the second scan signal G2). When the first scan signal and the second scan signal alternately output the high voltage potential, the driving transistors of the display panel and the display device endure the high voltage potential for half durations in comparison with the present pixel driving circuit. Thus, the possibility of afterimages can be reduced.

Figure 3:
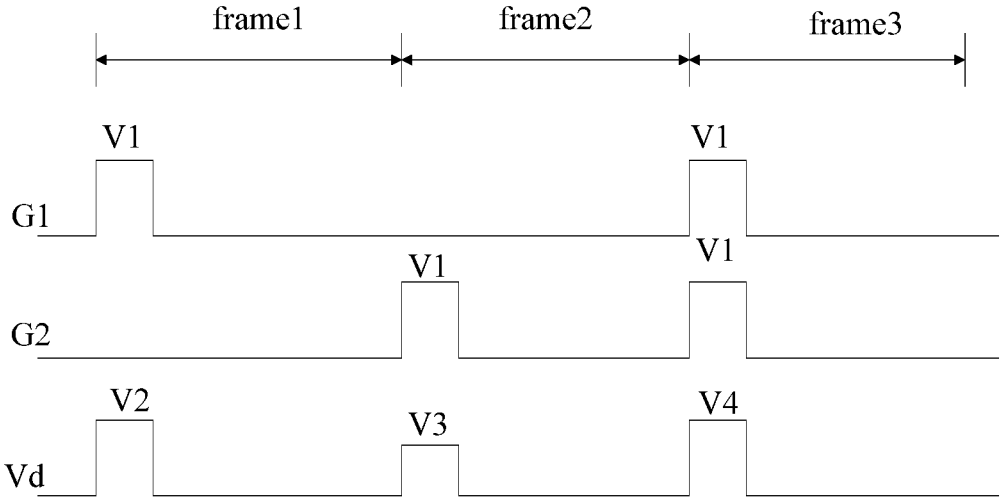
FIG. 3 illustrates signal time sequence diagram of the pixel driving circuit of the embodiment of the present disclosure.

FIG. 3 illustrates signal time sequence diagram of the pixel driving circuit of the embodiment of the present disclosure. For example, the pixel driving circuit may be driven by the first transistor T1 in a first frame frame1, driven by the third transistor T3 in a second frame frame2, and driven by the first transistor T1 and the third transistor T3 simultaneously in a third frame frame3. In the first frame frame1, the first scan signal G1 is at the high voltage potential so that the first transistor T1 provides the first driving electric current I1 to the OLED. In the second frame frame2, the second scan signal G2 is at the high voltage potential so that the third transistor T3 provides the second driving electric current I2 to the OLED. In the third frame frame3, the first scan signal G and the second scan signal G2 are at the high voltage potential so that the first transistor T1 and the third transistor T3 simultaneously provide the first driving electric current I1 and the second driving electric current I2 to the OLED. A driving electric current flowing through the OLED Ioled is a sum of the first driving electric current I1 and the second driving electric current I2.

The pixel driving circuit of the present disclosure utilizes two symmetrical sets of switch transistors and driving transistors to alternately provide driving currents to the OLED in order to reduce the duration that the gates of the driving transistors endure the high voltage potential and reduce the possibility of afterimages. When high-brightness display (HDR) is required, both sets of the switch transistors will be turned on together to increase the current flowing through the OLED to reduce the possibility of afterimages while the duration that the driving transistors endure the high voltage potential.

The above is only the preferred implementation of the present disclosure. It should be noted that, for a skilled person in the art, without departing from the aspects of the present disclosure, improvements and modifications can be obtained. These improvements and modifications also fall in the protected scope of the present disclosure.

What is claimed is:

1. A pixel driving circuit, comprising:

a first transistor, wherein a source of the first transistor receives a high voltage source;

a second transistor, wherein a source of the second transistor receives a data signal voltage, a gate of the second transistor receives a first scan signal, and a drain of the second transistor is connected to a gate of the first transistor;

a third transistor, wherein a source of the third transistor receives the high voltage source;

a fourth transistor, wherein a source of the fourth transistor receives the data signal voltage, a gate of the fourth transistor receives a second scan signal, and a drain of the fourth transistor is connected to a gate of the third transistor; and an organic light-emitting diode (OLED), wherein an anode of the OLED is connected to a drain of the first transistor and a drain of the third transistor, and a cathode of the OLED is connected to a low reference voltage potential;

wherein the source of the second transistor is connected to a first data signal line, the source of the fourth transistor is connected to a second data signal line, the source of the first transistor and the source of the third transistor are short-circuited, and the drain of the first transistor and the drain of the third transistor are short-circuited;

wherein in a first frame, the first scan signal is at a high voltage potential, the second scan signal is at a low voltage potential, and the first transistor provides a first driving electric current to the OLED;

wherein in a second frame, the second scan signal is at the high voltage potential, the first scan signal is at the low voltage potential, and the third transistor provides a second driving electric current to the OLED;

wherein in a third frame, the first scan signal and the second scan signal are both at the high voltage potential, the first transistor provides the first driving electric current to the OLED, the third transistor provides the second driving electric current to the OLED, and a driving electric current flowing through the OLED is a sum of the first driving electric current and the second driving electric current;

wherein the pixel driving circuit is driven by the first transistor in the first frame, the pixel driving circuit is driven by the third transistor in the second frame, and the pixel driving circuit is driven by the first transistor and the third transistor simultaneously in the third frame, and when high-brightness display is performed by the pixel driving circuit, the second transistor and the fourth transistor are turned on together to increase current flowing through the OLED.

2. The pixel driving circuit according to claim 1, wherein the second transistor transmits the data signal voltage to the gate of the first transistor when the first scan signal is at a high voltage potential, and the fourth transistor transmits the data signal voltage to the gate of the third transistor when the second scan signal is at the high voltage potential.

3. A pixel driving circuit, comprising:

a first transistor, wherein a source of the first transistor receives a high voltage source;

a second transistor, wherein a source of the second transistor receives a data signal voltage, a gate of the second transistor receives a first scan signal, and a drain of the second transistor is connected to a gate of the first transistor;

a third transistor, wherein a source of the third transistor receives the high voltage source;

a fourth transistor, wherein a source of the fourth transistor receives the data signal voltage, a gate of the fourth transistor receives a second scan signal, and a drain of the fourth transistor is connected to a gate of the third transistor; and an organic light-emitting diode (OLED), wherein an anode of the OLED is connected to a drain of the first transistor and a drain of the third transistor, and a cathode of the OLED is connected to a low reference voltage potential;

wherein in a first frame, the first scan signal is at a high voltage potential, the second scan signal is at a low voltage potential, and the first transistor provides a first driving electric current to the OLED;

wherein in a second frame, the second scan signal is at the high voltage potential, the first scan signal is at the low voltage potential, and the third transistor provides a second driving electric current to the OLED;

wherein in a third frame, the first scan signal and the second scan signal are both at the high voltage potential, the first transistor provides the first driving electric current to the OLED, the third transistor provides the second driving electric current to the OLED, and a driving electric current flowing through the OLED is a sum of the first driving electric current and the second driving electric current;

wherein the pixel driving circuit is driven by the first transistor in the first frame, the pixel driving circuit is driven by the third transistor in the second frame, and the pixel driving circuit is driven by the first transistor and the third transistor simultaneously in the third frame, and when high-brightness display is performed by the pixel driving circuit, the second transistor and the fourth transistor are turned on together to increase current flowing through the OLED.

4. The pixel driving circuit according to claim 3, wherein the source of the second transistor is connected to a first data signal line, the source of the fourth transistor is connected to a second data signal line, the source of the first transistor and the source of the third transistor are short-circuited, and the drain of the first transistor and the drain of the third transistor are short-circuited.

5. The pixel driving circuit according to claim 3, wherein the second transistor transmits the data signal voltage to the gate of the first transistor when the first scan signal is at a high voltage potential, and the fourth transistor transmits the data signal voltage to the gate of the third transistor when the second scan signal is at the high voltage potential.

6. A pixel driving method, comprising:

receiving a high voltage source by a source of a first transistor;

receiving a data signal voltage by a source of a second transistor, wherein a gate of the second transistor receives a first scan signal, a drain of the second transistor is connected to a gate of the first transistor, and the second transistor transmits the data signal voltage to the gate of the first transistor when the first scan signal is at a high voltage potential;

receiving the high voltage source by a source of a third transistor;

receiving the data signal voltage by a source of a fourth transistor, wherein a gate of the fourth transistor receives a second scan signal, a drain of the fourth transistor is connected to a gate of the third transistor, and the fourth transistor transmits the data signal voltage to the gate of the third transistor when the second scan signal is at the high voltage potential; and connecting an anode of an organic light-emitting diode (OLED) to a drain of the first transistor and a drain of the third transistor, and connecting a cathode of the OLED to a low reference voltage potential;

wherein in a first frame, the first scan signal is at the high voltage potential and the second scan signal is at a low voltage potential, the first transistor provides a first driving electric current to the OLED; and wherein in a second frame, the second scan signal is at the high voltage potential, the first scan signal is at the low voltage potential, and the third transistor provides a second driving electric current to the OLED;

wherein in a third frame, the first scan signal and the second scan signal are both at the high voltage potential, the first transistor provides the first driving electric current to the OLED, the third transistor provides the second driving electric current to the OLED, and a driving electric current flowing through the OLED is a sum of the first driving electric current and the second driving electric current;

wherein the pixel driving method performed by a pixel driving circuit is driven by the first transistor in the first frame, the pixel driving circuit is driven by the third transistor in the second frame, and the pixel driving circuit is driven by the first transistor and the third transistor simultaneously in the third frame, and when high-brightness display is performed by the pixel driving circuit, the second transistor and the fourth transistor are turned on together to increase current flowing through the OLED.

* * * * *